United States Patent [19]

Brauer

[11] 4,123,927

[45] Nov. 7, 1978

[54] ROLLING MILL

[75] Inventor: Hans Brauer, Leichlingen, Fed. Rep. of Germany

[73] Assignee: Friedrich Kocks GmbH & Co., Dusseldorf, Fed. Rep. of Germany

[21] Appl. No.: 839,009

[22] Filed: Oct. 3, 1977

Related U.S. Application Data

[63] Continuation of Ser. No. 705,293, Jul. 14, 1976, abandoned.

[51] Int. Cl.[2] ..... B21B 37/02

[52] U.S. Cl. ..... 72/16; 72/17; 72/234; 72/250; 72/7

[58] Field of Search ..... 72/8, 9, 10, 12, 14, 72/16, 17, 234

[56] References Cited

U.S. PATENT DOCUMENTS

| | | | |
|---|---|---|---|
| 3,553,993 | 1/1971 | Frostick | 72/11 |
| 3,650,135 | 3/1972 | Shelton et al. | 72/8 |
| 3,763,678 | 10/1973 | Dornbusch et al. | 72/9 |

*Primary Examiner*—Milton S. Mehr

*Attorney, Agent, or Firm*—Buell, Blenko & Ziesenheim

[57] ABSTRACT

Means are provided for adjusting the rotational speed of at least the first pass of a plurality of successive rolling mill passes by measuring the cross section of the work-material being fed to said first pass and adjusting the drive for at least said first pass responsive to said measurement so as to feed to the last pass of the successive passes a cross section which permits at least said last pass to operate at a rotational speed independent of the cross section of the feed material.

6 Claims, 2 Drawing Figures

ROLLING MILL

Figure 1:
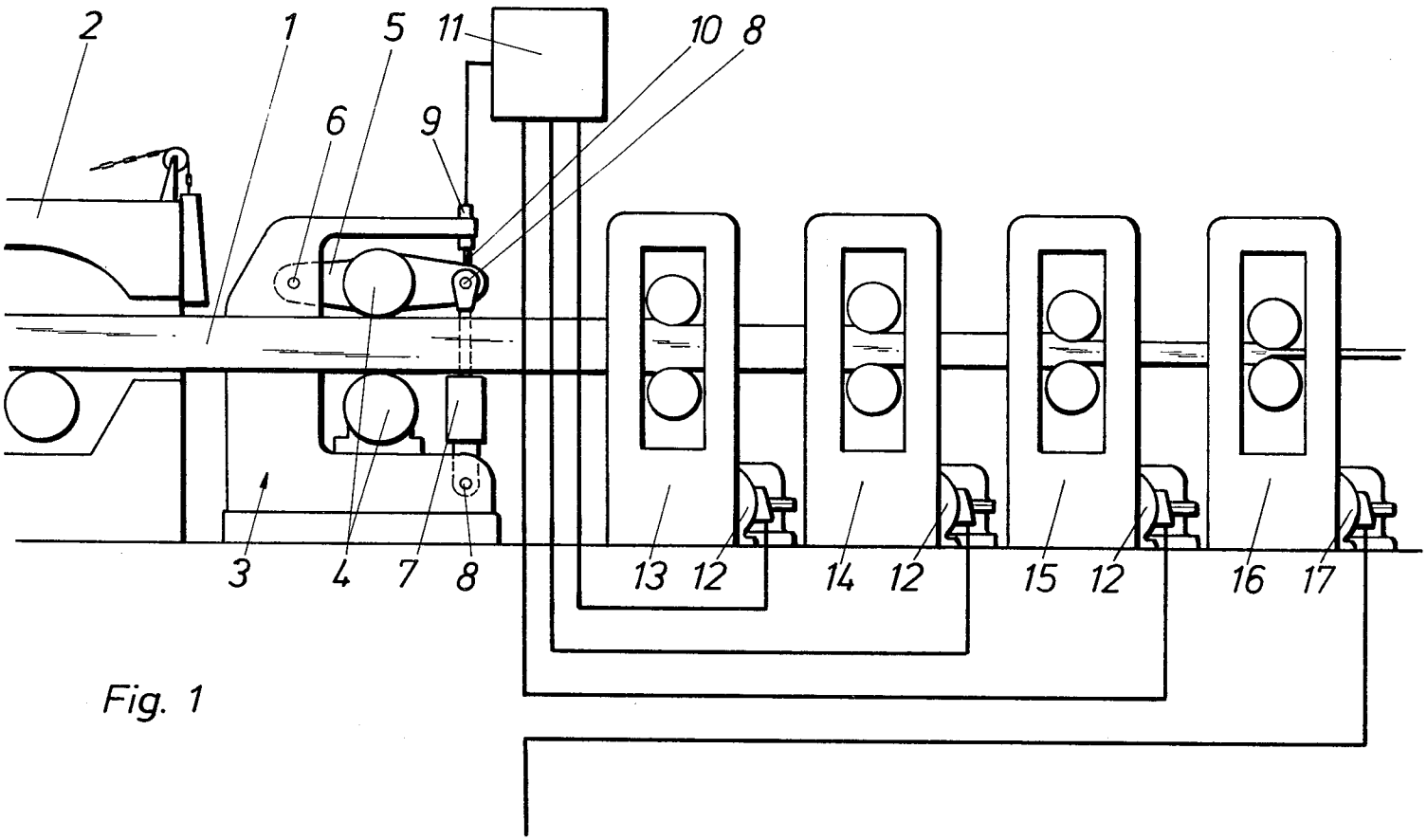

This application is a continuation of my copending application Ser. No. 705,293, filed July 14, 1976, now abandoned.

The present invention relates to rolling mills and particularly to a rolling mill for rolling wire, rods or profiled bars.

In the conventional form of known rolling mill for wire, bars or profiles, the work-material, coming from a furnace and heated to the rolling temperature, is introduced by a feeder having driven rollers into the sizing pass of the first roller stand of a roughing train where the workpiece is deformed for the first time. Immediately following this, the work-material passes through, for example, three further roller stands of the roughing train and, after passing through these three further roller stands, the cross sectional dimensions of the work-material have been reduced such that the work-material can be further processed in the following intermediate and finishing trains.

In order to obtain a satisfactory finished product, which lies within the prescribed dimensional tolerances and which is uniform over its entire length, it has been necessary in rolling mills of this type that the cross-sectional area of the work-material, coming from the furnace and entering the first pass, should conform as accurately as possible to the nominal cross-sectional area for which the rolling mill and its row of sizing passes have been designed. Departures from prescribed tolerance, due to the entering cross-sectional area exceeding or falling below the nominal entering cross-sectional area (disregarding very slight differences), result in a need for re-finishing work or scrapping of the work-material. Thus, in conventional rolling mills, it is impossible to equalize greatly varying first pass entry cross-sectional areas during the course of the rolling operation such that they do not affect the finished product or do not affect the finished product to any appreciable extent.

By way of example, when starting material having a cross-sectional area larger than the nominal cross-sectional area enters a roughing train whose sizing passes and roller speeds are designed for work-material of the nominal cross-sectional area entering the first sizing pass; the speed at which the material enters the first sizing pass cannot be as great as that in the case of the nominal cross-sectional area owing to the larger quantity of material per unit of length. This lower speed usually does not itself cause any trouble, since no other rolling stand is arranged in front of the first sizing pass of the roughing train. However, owing to the larger first pass cross section, the first sizing pass effects a greater reduction in the cross section, since the sizing pass opening remains the same. In addition to the greater reduction in the cross-sectional area the cross-sectional area of the work-material leaving the first sizing pass is greater than it would be in the case of the nominal first pass entry cross-sectional area. According to the shape of the sizing pass and the type of work-material, the exit cross-sectional area is then increased by approximately 35 to 50% of the change in the reduction of the cross-sectional area. This increase in the exit cross-sectional area is caused by greater filling of the given sizing pass opening. Since the delivery speed from the first sizing pass also remains the same with the same rotational speed of the rollers, although a larger cross-sectional area leaves the first sizing pass for the reasons given above, a larger quantity of material per unit of length is fed to the second sizing pass than in the case of the desired first pass entry cross-sectional area and a compressive stress or a reduction in tension occurs in the work-material between the first sizing pass and the second sizing pass. Consequently, the second sizing pass is also filled to a greater extent than would be the case with nominal first pass entry cross-sectional area. Corresponding conditions also apply to all the other sizing passes which, with a larger first pass entry cross-sectional area, are also filled to a greater extent than that provided for.

Thus, with substantially the same delivery speed, and when the first pass entry cross-sectional area is increased relative to the nominal first pass entry cross-sectional area, the roughing train of the rolling mill feeds a larger quantity of material per unit of length into the continuously operating intermediate and finishing trains arranged beyond the roughing train. For substantially the same reasons, the larger first pass entry cross-sectional area also leads to greater filling of the sizing passes in the intermediate and finishing trains and, beyond the last finishing stand, to a finished product having larger dimensions or tolerances than those desired. The opposite applies when the first pass entry cross-sectional area is smaller than the nominal first pass entry cross-sectional area when the sizing passes are filled to a lesser extent and the required minimum dimensions of the finished work-material are then not attained.

However, for a great variety of reasons, it is not always possible to accurately comply with the predetermined or nominal first pass entry cross-sectional area required with the conventional construction of such rolling mills. Furthermore, it is also desirable to be able to process starting material having larger or smaller cross-sectional areas than permitted tolerance variations in the nominal cross-sectional area.

The present invention relates to adjusting means for compensating for differing first pass entry cross-sectional areas in a roughing train of a rolling mill for wire, bars or profiles, which roughing train is equipped with a single regulable stand drive and roller which are non-adjustable during the rolling operation. The roller stands may be adjustable throughout, although the sizing passes are not to vary during the rolling operation.

A feature of the invention is to provide an apparatus which makes available, at the delivery side of the roughing train, work-material having a substantially uniform cross-sectional area and a uniform delivery speed, irrespective of fluctuations in the first pass entry cross-sectional area within substantially wider limits than those which can be tolerated in known rolling mills.

In accordance with the invention, adjusting means for a rolling mill for wire, rod or profiled bars comprising a measuring device arranged at the entry end in front of the first pass of a row of passes for making a measurement indicative of the cross-sectional area of the work-material entering the first pass, and an adjusting device for varying the rotational speed of the rollers at at least the first pass responsively to said measurement, whereby the rotational speeds of the rollers of the first pass or passes are varied in the sense of maintaining the longitudinal tension compression conditions in conformity with the nominal cross-sectional area to enter the first pass to compensate for measured variations in the cross-sectional area entering the first pass, while the rollers of the last pass or passes of the row have rotational speeds substantially independent of the actual value of the cross-sectional area of the work-material entering the first pass.

In a rolling mill having the adjusting means in accordance with the invention, work-material having a substantially uniform cross-sectional area is obtained in an advantageous manner beyond the last stand of the roughing train, even when the first pass entry cross-sectional area fluctuates. Furthermore, this work-material having a uniform cross-sectional area is delivered out of the last roller stand of the roughing train at a virtually constant speed. Both these features render it possible to obtain, in particular, close tolerances in the finished product in the intermediate and/or finishing trains, in addition to carrying out the further rolling process in a trouble-free manner. This is achieved without varying the adjustment of the rollers and without changing the rollers or effecting any other conversions. The arrangement of a measuring device in front of the first stand ensures that all the differences in the cross-sectional area between individual pieces of the starting material are detected in addition to differences which may exist along the length of one and the same piece. Even irregularities of this type can be compensated in accordance with the invention.

In a preferred embodiment of the invention, the measuring device is arranged on a feeder for feeding the work-material to the first roller stand, and the distances, varying in conformity with the cross-sectional area of the work-material, between the drive rollers which convey the work-material therebetween, act as measured values for the adjusting device. In addition to this preferred embodiment, there are doubtless other possibilities of measuring the first pass cross-section continuously or at fixed intervals.

The invention is further described by way of example, with reference to the accompanying drawings, in which:

FIG. 1 is a side elevation of part of a rolling mill in accordance with the invention; and FIGS. 2A to 2E are diagrammatic illustrations of the sizing passes of the rolling mill of FIG. 1.

The work-material, designated 1 in FIG. 1, is taken from a furnace 2 from which it is drawn by a work-material feeder 3. The feeder 3 has driven rollers 4, the upper roller being mounted on a pivoted lever 5. The pivoted lever 5 is pivotably arranged on the housing of the feeder 3 by means of a pivot 6, so that the distance between the two rollers 4 can vary in conformity with the cross-section of the work-material 1. The upper roller 4 is pressed onto the work-material 1 by means of an hydraulic cylinder 7, for which purpose the hydraulic cylinder 7 is secured to the housing of the feeder 3 and to the pivoted lever 5 by pivots 8.

The feeder 3 feeds the work-material 1 to a row of sizing passes defined by roller stands 13, 14, 15 and 16 which constitute at least part of a roughing train. Each of the roller stands 13 to 16 has an individual driving motor 12 or 17 of which at least the driving motors 12 of the stands 13 to 15 are variable speed. The stand 16 can be followed by further stands (not shown) of the roughing train.

A special position sensor 9, rigidly arranged on the housing of the feeder 3, records the movements of the pivoted lever 5 by means of a feeler pin 10 and thus records any change in the distance between the rollers 4. This distance is indicative of the cross-sectional area of the work-material 1. The measured values thus ascertained are fed to an control device 11 which then imparts to the motors 12 of the front roller stands 13, 14, 15 the particular rotational speed required for the motors 12. The motor 17, which drives the last stand 16 in the rolling direction, is not connected to the control device 11, since the rotation speed of the rollers of this stand remains constant irrespective of the first pass entry cross-sectional area of the work-material 1.

The basis of the proposed change in the rotational speed of the rollers of the first stand or stands 13 to 15 for the purpose of compensating for the differing first pass entry cross-sectional areas is that the delivery speed from the last stand 16 is to be substantially constant and thus also the rotational speed of the rollers of the last stand 16 is also to remain constant. Therefore, only the rotational speeds of the rollers of the first stand or stands 13 to 15 need to be varied in accordance with the measured first pass entry cross-sectional area. Thus, a single drive is not essential for the last stand and the last stand but one, nor perhaps for a further one of the rear stands of the roughing train, and a group drive, advantageous in itself, may be used for these stands in place of the individual drive motor 17 itself.

However, in order to maintain the cross-sectional area of the work-material constant beyond the last stand of the roughing train, in addition to maintaining the delivery speed constant, the total reduction in the cross-sectional area in the front stands 13 to 15 must be greater when a first pass entry cross-sectional area which is, for example, larger than the nominal first pass entry cross-sectional area. Namely, the filling in the last sizing pass should not be increased or should not be increased to any substantial extent. This is achieved by a corresponding decrease in the rotational speeds of the rollers which is at a maximum at the first stand 13 in the rolling direction and which is zero at the last stand 16. The individual rotational speeds, at which the tension/-compression conditions correspond to those which exist with the nominal first pass entry cross-sectional area can be predetermined for any other first pass entry cross-sectional area. Upon compliance with these rotational speeds, the front sizing passes are also filled to a greater extent than in the case of the nominal first pass entry cross-sectional area, although this larger filling continuously decreases from the first to the last stand of the roughing train owing to the rotational speed regulation in accordance with the invention, and the cross-sectional area delivered from the last stand remains substantially constant. Since the rotational speeds decrease with a larger first pass entry cross-sectional area, it is necessary to increase the rotational speed of the rollers of the front stand or stands 13 to 15 in the case of a smaller first pass entry cross-sectional area, thus to compensate for the increase in tension which otherwise occurs, and the smaller filling of the sizing passes occasioned thereby.

Figure 2:
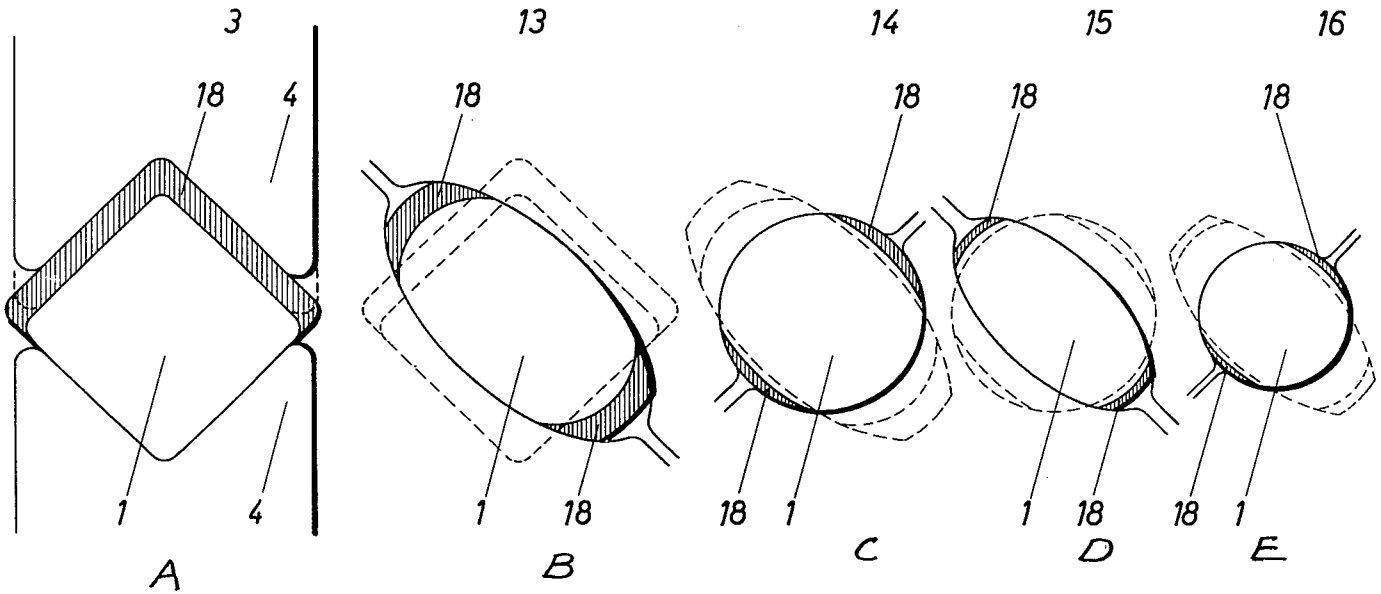

FIG. 2A shows the rollers 4 of the feeder 3 engaging the work-material 1. FIGS. 2B to 2E show respectively the sizing passes defined by the rollers 19 to 22 of the four stands 13 to 16. FIGS. 2B to 2E clearly show how the larger filling relative to the nominal first pass entry cross-sectional area decreases in the individual sizing passes from the first stand 13 towards the last stand 16 where it is only negligible. The increased cross-sectional area designated 18 is shown by hatching in each case.

It is advisable to precalculate the individual rotational speeds of the rollers of the first stand or stands 13 to 15 for the various first pass entry cross-sectional areas and to feed them into a memory from where they can be automatically supplied to the roller stand drive by means of the control device 11 in dependence upon the measured values of the measuring device 9. Thus, according to their magnitude, the measured values of the measuring device 9 address predetermined rotational speeds of the rollers to each individual roller stand 13, 14 or 15.

Alternatively, it is also possible, by means of a computer, to freshly determine the individual rotational speeds of the rollers of the first stand or stands 13 to 15 for the various first pass cross sections in conformity with the measured values of the measuring device 9 in each case and then to feed them automatically to the roller stand drive by means of the control device 11.

The invention has been described with reference to a roughing train, since the invention is of particular importance in this connection. Basically, however, it can be used with different trains or roller stands arranged one behind the other for the purpose of compensating for differing first pass entry cross-sectional areas.

It will be appreciated that the invention is not limited to a specific number of roller stands, and the number of individually regulable roller stands, or roller stands rotating at a constant speed, can also vary.

Thus, while I have illustrated and described a presently preferred practice and embodiment of my invention, it will be understood that this invention may be otherwise embodied within the scope of the following claim.

I claim:

1. Adjusting means for a roughing rolling mill for wire, bars, profiles and the like having a plurality of successive roll passes in the same plane, comprising a measuring device arranged at the entry end in front of the first pass of said plurality of successive passes for making a measurement indicative of the cross-sectional area of the work-material entering the first pass, and an adjusting device for selectively varying the rotational speed of the rollers at each pass except at least the last pass of said plurality of passes responsively to said measurement, whereby the rotational speeds of the rollers of each of said passes except at least the last pass may be varied so as to maintain the longitudinal tension compression conditions in conformity with the nominal cross-sectional area to enter each pass to compensate for measured variations in the cross-sectional area entering the first pass to provide a substantially uniform preselected cross-section of material entering said last pass, while maintaining the rollers of at least the last pass of the plurality of successive passes at rotational speeds substantially independent of the actual value of the cross-sectional area of the work-material entering the first pass.

2. Adjusting means as claimed in claim 1, in which the measuring device is arranged on a feeder having drive rollers for feeding the work-material to the first pass of the plurality of successive passes for measuring the distances between the drive rollers which convey the work-material therebetween, which distances vary in conformity with the cross-sectional area of the work-material.

3. Adjusting means as claimed in claim 1 having a memory apparatus in which is stored information concerning the individual rotational speeds of the rollers of at least the first pass, pre-calculated for the various work-material cross-sectional areas for entry into the first pass the adjusting device being adapted to feed the appropriate speed information to a drive means for the rollers of each pass except at least the last pass in dependence upon the measurements made by the measuring device.

4. Adjusting means as claimed in claim 1 having a computer for respectively ascertaining the individual rotational speeds of the rollers of at least the first pass for the various first pass entry cross-sectional areas in conformity with the values measured by the measuring device and for automatically feeding such speeds to a roller stand drive for driving the rollers of each pass except at least the last pass by means of the adjusting device.

5. In combination a feeder for a roughing rolling mill for wire, bars, profiles and the like, said feeder having drive means engaging said wire, bars, profiles and the like for advancing the same through the feeder, said drive means being variable for varying cross-sections of material being driven, measuring means on said feeder measuring the variation in said drive means, a plurality of successive roughing mill stands having forming rolls forming a pass line receiving material from said feeder to shape the same, variable drive means for each stand of said pass line receiving material from the feeder except at least the last pass and control means between said measuring means and said variable drive means varying said drive means in accordance with variations in said material being driven by the drive means.

6. The combination claimed in claim 5 wherein the control means includes memory apparatus having stored information concerning the individual rotational speeds of the forming rolls of each roll stand, except at least the last, pre-calculated for various work-material cross-sectional areas and adapted to feed appropriate speed information to the variable drive means for each stand, except at least the last, as modified by the measurements made by the measuring means.

* * * * *